US007089693B2

(12) United States Patent
Collins et al.

(10) Patent No.: US 7,089,693 B2
(45) Date of Patent: Aug. 15, 2006

(54) DREDGING METHOD AND APPARATUS

(75) Inventors: James G. Collins, Melbourne Beach, FL (US); Daniel J. Levy, Plantation, FL (US)

(73) Assignee: EA Engineering Science and Technology, Inc., Hunt Valley, MD (US)

( * ) Notice: Subject to any disclaimer, the term of this patent is extended or adjusted under 35 U.S.C. 154(b) by 0 days.

(21) Appl. No.: 10/359,520

(22) Filed: Feb. 5, 2003

(65) Prior Publication Data

US 2004/0148813 A1 Aug. 5, 2004

(51) Int. Cl.
*E02F 3/16* (2006.01)

(52) U.S. Cl. ..... 37/309; 37/320; 37/333

(58) Field of Classification Search ..... 37/309, 37/310, 317, 320, 333, 334
See application file for complete search history.

(56) References Cited

U.S. PATENT DOCUMENTS

| | | | | | |
|---|---|---|---|---|---|
| 3,783,535 | A * | 1/1974 | Hanks | 37/316 |
| 3,943,644 | A * | 3/1976 | Walz | 37/314 |
| 4,085,781 | A * | 4/1978 | Serpas et al. | 141/1 |
| 4,123,858 | A * | 11/1978 | Batchelder | 37/313 |
| 4,146,982 | A * | 4/1979 | Norisugi | 37/310 |
| 4,152,800 | A | 5/1979 | Nilsmar | 15/1.7 |
| 4,267,652 | A | 5/1981 | Senesac | 37/66 |
| 4,307,525 | A | 12/1981 | Maloblocki | 37/65 |
| 4,401,576 | A | 8/1983 | Meurer | 210/803 |
| 4,470,208 | A | 9/1984 | Van Berk et al. | 36/63 |
| 4,631,844 | A | 12/1986 | Deal | 37/58 |
| 4,658,751 | A | 4/1987 | Koot | 114/270 |
| 4,713,896 | A * | 12/1987 | Jennens | 37/308 |
| 4,776,112 | A | 10/1988 | Urbani | 37/58 |
| 4,957,622 | A | 9/1990 | Mims | 210/170 |
| 5,167,841 | A | 12/1992 | Mims | 210/805 |
| 5,639,185 | A * | 6/1997 | Saxon | 405/163 |
| 5,732,487 | A | 3/1998 | De Kerckhove | 37/333 |
| 6,625,907 | B1 | 9/2003 | Murray et al. | 37/332 |
| 6,755,701 | B1 * | 6/2004 | Dornier et al. | 440/36 |

* cited by examiner

*Primary Examiner*—Victor Batson
(74) *Attorney, Agent, or Firm*—Larry J. Guffey

(57) ABSTRACT

An improved hydraulic dredging apparatus for removing a sediment layer from an underlying substrate lying below a water surface includes a receptacle having an open-front portion through which is sediment is collected, means for attaching the dredging apparatus to the submersible end of a boom that extends from a surface vehicle, a hydraulic pump for pumping a sediment and water slurry to the water's surface. The improvements to this dredging apparatus further include a buoyancy compensation chamber for allowing the pressure of the receptacle on the underlying substrate to be controlled, a load cell that determines the degree to which the receptacle is full of sediment, a water manifold system that allows water to be added to the receptacle's contents so as to control the percentage solids content of the slurry being pumped, bottom slide runner that prevents the receptacle from digging too deeply into the underlying substrate and an intake visor that is affixed to a top, leading edge of the receptacle for the purpose of controlling the area of the receptacle's front opening.

16 Claims, 3 Drawing Sheets

DREDGING METHOD AND APPARATUS

BACKGROUND OF THE INVENTION

1. Field of the Invention

The present invention relates to excavating beneath a body of water. More particularly, this invention relates to a method an apparatus for providing an improved means for removing a sediment layer from a sand substrate lying below a water surface.

2. Description of the Related Art

The dredging of the bottoms of bodies of water usually takes one of two forms, hydraulic (i.e., suction) dredging or mechanical (bucket loading) dredging. These systems are briefly discussed below.

Hydraulic dredging operations often include a boom or ladder pivotally suspended from a floating vessel to guide the underwater movement of an excavating head or dredging attachment along a bottom surface. The excavated material is removed in a slurry form by suction pressure through a conveying conduit for discharge. Because the percentage solids concentration of such a slurry is relatively low, the operation of such systems has the disadvantage that they often result in large volumes of water that must be treated so as to remove their suspended solids before this water can be returned to its source or discharged off site.

In mechanical dredging systems, buckets extending from a surface vessel are used to "scoop" the bottom material and then raised to the surface where the dredged material is deposited in an adjacent barge or other container capable of receiving the material from the bucket. While the outputs from these systems are at considerable higher percentage solids concentrations, resulting in smaller volumes of water to be treated, they can result in high degrees of contaminants in the surrounding waters as the dredged materials escape from the buckets as they are raised and lowered from the surface.

These systems have often been the subject of patents. For example, see U.S. Pat. Nos. 4,152,800, 4,267,652, 4,307,525, 4,401,576, 4,470,208, 4,631,844, 4,658,751, 4,776,112, 4,957,622, 5,167,841 and 5,732,487.

However, in spite of the extensive prior art in this area, current dredging systems continue to exhibit various limitations in their capabilities. Some of these include the need to: (1) minimize the quantities of intake water that must be treated as a result of a dredging operation, (2) minimize the generation of suspended solids and contaminants in the waters surrounding a dredging site, (3) more precisely remove a varying thickness, sediment layer from an uneven bottom surface, and (4) minimize the effects of varying sea conditions on the preciseness that can be achieved in the dredging operation (i.e., removal of all of the desired mud or other materials without cutting into the underlying bottom surface (e.g., sand substrate)).

Thus, there exists a continuing need for improved dredging methods and apparatus.

3. Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide a method and apparatus for dredging that overcomes the limitations and problems identified with prior dredging systems and methods.

It is another object of the present invention to provide a means for making well determined and controlled thickness dredgings.

It is a yet another object of the present invention to provide a method and apparatus that allow for shallow waters to be effectively dredged.

It is a further object of the present invention to provide a dredging apparatus and method that will have a minimal, negative environmental impact.

These and other objects and advantages of the present invention will become readily apparent as the invention is better understood by reference to the accompanying summary, drawings and the detailed description that follows.

SUMMARY OF THE INVENTION

The present invention is generally directed to satisfying the needs set forth above and overcoming the limitations and problems identified with prior dredging systems.

In accordance with one preferred embodiment, the present invention takes the form of an improved excavator head or dredging apparatus for removing a sediment layer from a sand substrate lying below a water surface. The basic, prior art dredging attachment or apparatus that has been improved upon is usually used with a surface vessel that has an excavator tube and boom to which the dredging attachment is attached. A high-solids concentration, submersible, hydraulic pump is used to pump a sediment and water slurry from the dredging attachment to a collection vessel located on the water's surface.

The improvements to such a dredging apparatus include: (a) a buoyancy compensation chamber attached to a wall of the dredging attachment that allows the pressure of the dredging attachment on the underlying substrate to be controlled, (b) a load cell which is mounted in the top of the dredging attachment and is used to measure the load in the dredging attachment so as to determine when the dredging attachment is full of collected sediment, (c) an on-demand, jet water manifold system that allows water to be added to the dredging attachment's contents so as to control the percentage solids content of the slurry being pumped to the water's surface, (d) bottom slide runners that protrude from the lower, leading edge of the dredging attachment for the purposes of preventing the attachment from digging too deeply into the underlying substrate, (e) a means for connecting the excavator boom to the dredging attachment so that it can ride smoothly over uneven bottom surfaces, and (f) an adjustable intake visor which is used to control the area of the dredging attachment's inlet or opening.

This improved hydraulic dredging apparatus operates by: (i) placing the underside of the dredging attachment on the top of the submerged surface to be dredged, then adjusting the dredging attachment's buoyancy compensation chambers so that the attachment's sliding pressure is just enough to displace the to-be-dredged, sediment layer without penetrating the underlying sand substrate, (ii) moving the dredging attachment forward so that it becomes fully loaded with sediment, with this condition being discernable by monitoring the readings of the load cell, (iii) once the dredging attachment is fully loaded with sediment, initiating the pumping action of the pump while continuing to move forward at a rate of speed such that the dredging attachment stays fully loaded, and (iv) if the situation arises that the solids content within the slurry begins to exceed the pump's rated capacity, using the system's jet water manifold system to add water to the attachment's contents to reduce the slurry's solids content back to within an acceptable range.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

DESCRIPTION OF THE PREFERRED EMBODIMENT

For purposes of explanation and not limitation, specific details are set forth below in order to provide a thorough understanding of the present invention. However, it will be apparent to one skilled in the art that the present invention may be practiced in other embodiments that depart from these specific details. In other instances, detailed descriptions of well known methods, hardware, etc. are omitted so as not to obscure the description of the present invention with unnecessary detail.

Figure 1:
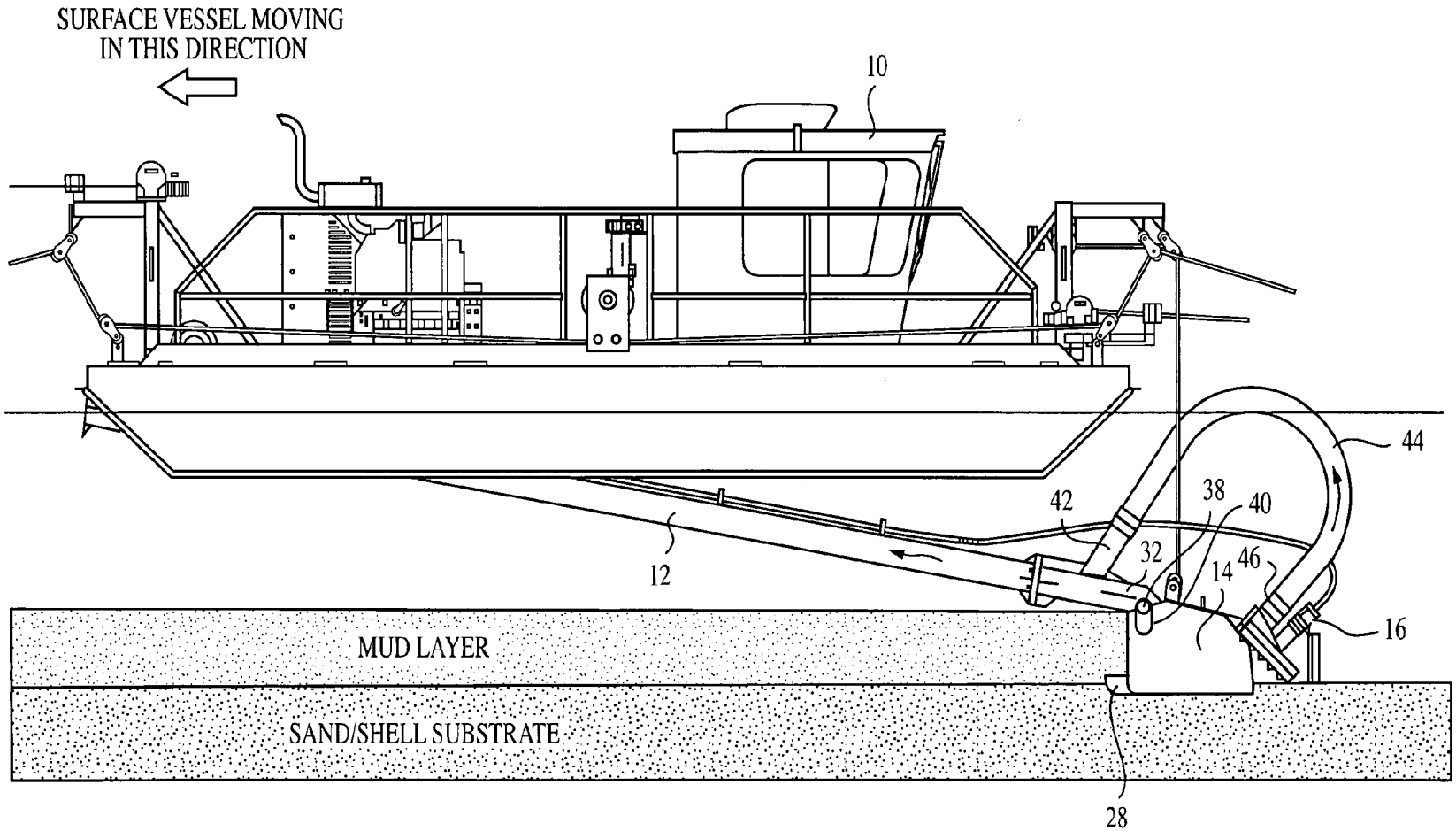
FIG. 1 provides a side view of a preferred embodiment of the present invention when it is in operation and being suspended from a surface vessel.
Figure 2:
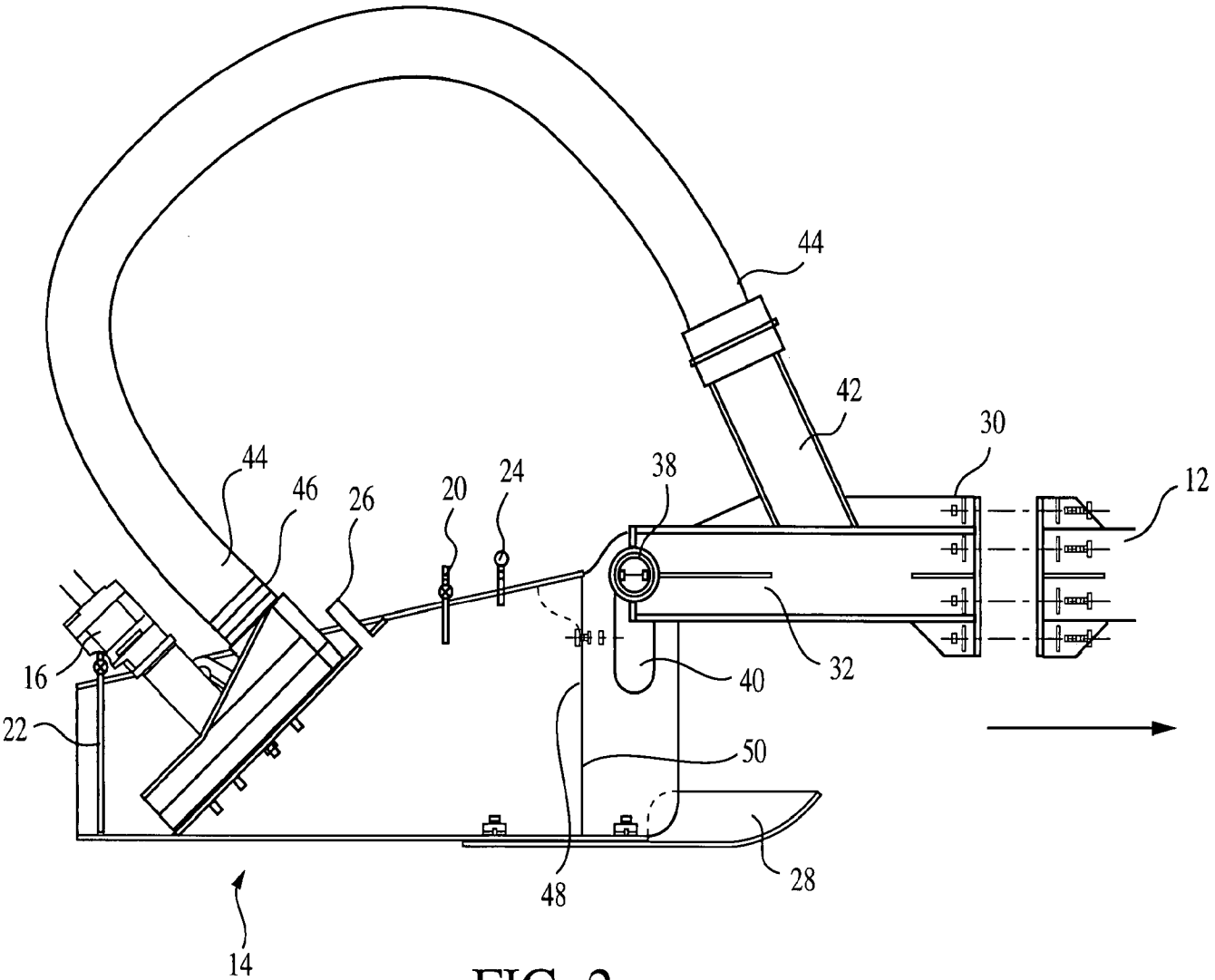
FIG. 2 shows a side view of the excavating head or dredging apparatus shown in FIG. 1.
Figure 3:
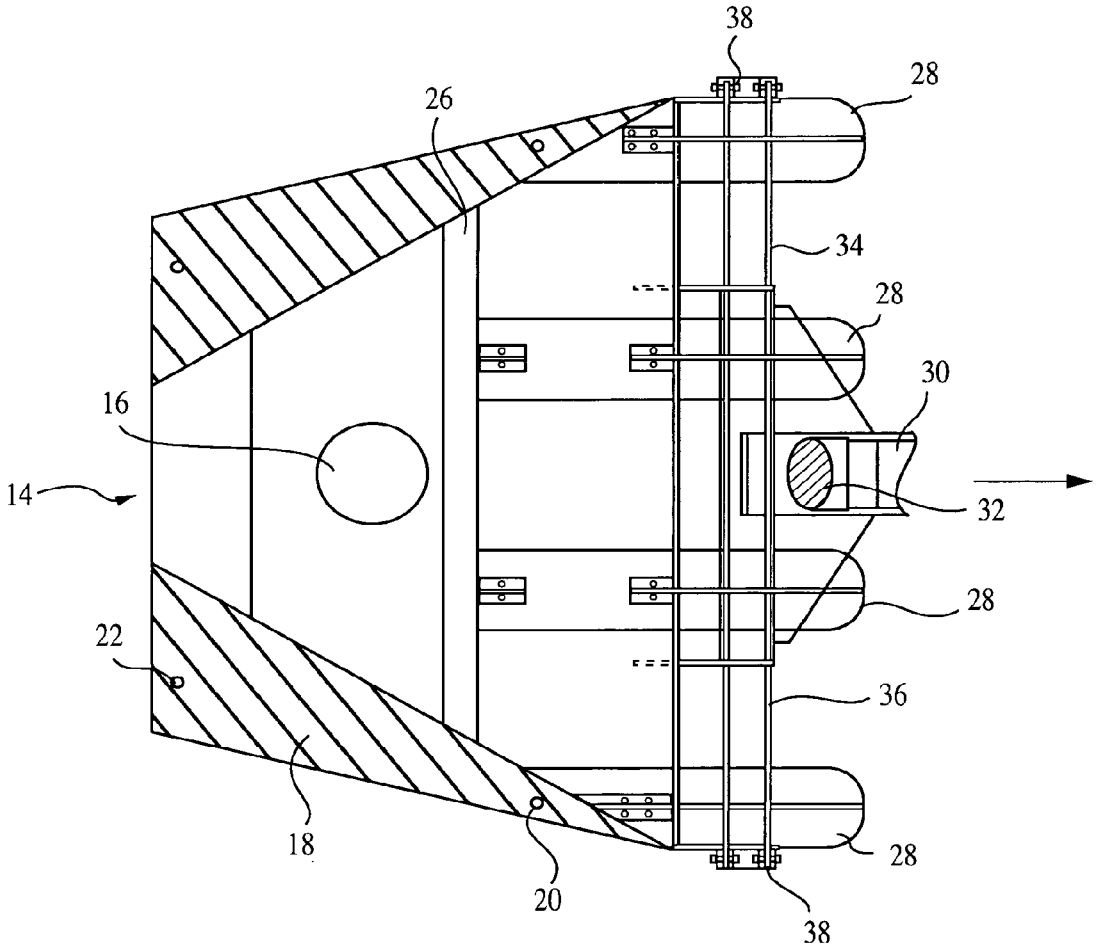
FIG. 3 shows a top view of the excavating head or dredging apparatus shown in FIG. 1.

Referring now to the drawings which show a preferred embodiment of the present invention and wherein like reference numerals designate like elements throughout, FIG. 1 is seen to provide a side view of a preferred embodiment of the dredging apparatus of the present invention when it is in operation and being suspended from a surface vessel.

The basic, prior art dredging system that has been improved upon includes a surface vessel 10 with an excavator tube and boom 12 and a sliding-head, dredging attachment, excavating head or receptacle 14 that is attached to the submerged end of the boom 12. A high-solids concentration, submersible, hydraulic pump 16 is used to pump a sediment and water slurry from the dredging attachment 14 to a collection vessel located on the water's surface or on a nearby shore.

The improvements of the present invention to the dredging attachment 14 include: a pair of attached buoyancy compensation chambers 18 which allow the sliding pressure of the attachment 14 on the underlying surface to be controlled, and a load cell 24 which is mounted in the top of the dredging attachment 14 and is used to measure the load in the dredging attachment so as to determine when the dredging attachment is full of collected sediment, with this being used as the criteria for when to start the pump 16 so to avoid running the pump in such a way that it is pumping primarily water and little sediment.

Such a load cell 24 can operate in many ways. For example, the top wall of the receptacle could be mounted to the rest of the receptacle in such a way that the top wall can moved upward a limited distance as a result of sediment being collected in the receptacle to such a level that it presses against this top wall. The load cell 24 would then measure a portion of this upward force being exerted on the receptacle's top surface.

An air intake valve 20 and a water discharge valve 22 are connected to the buoyancy compensation chambers. These are used to control their buoyancy.

The improvements also include: an on-demand, jet water manifold system 26 that allows water to be added to the attachment's contents so as to control the percentage solids content of the slurry being pumped to the water's surface, and bottom slide runners 28 that protrude from the lower, leading edge of the dredging attachment. These runners 28 are used to prevent the attachment 14 from digging too deeply into the underlying substrate.

Additionally, the means for connecting the excavator boom 12 to the dredging attachment 14 has been designed to ensure that the dredging attachment 14 can ride smoothly over uneven bottom surfaces. This is made possible by having a T-shaped connector arm 30 whose base leg 32 extends from the attachment and mates with the boom 12. The top legs 34, 36 of this arm extend on each side to connect with the respective sides of the dredging attachment. Each of these connections is made with pivot bearing 38 that is able to ride up and down in a slot 40 which is cut in the respective sides of the dredging attachment.

Since the excavator boom is hollow, this connector arm is also made hollow and it has a connector 42 which allows for the connection of a flexible hosing 44 from this connector to the pump's outlet 46. This arrangement makes it possible for the dredged material to make it's way to the surface by being pumped through the excavator tube or boom 12. An adjustable intake visor 48 is used to control the area of the dredging attachment's inlet or opening 50.

This improved hydraulic dredging apparatus operates by: (i) placing the underside of the dredging attachment 14 on the top of the submerged surface to be dredged, then adjusting the dredging attachment's buoyancy compensation chambers 18 so that the attachment's sliding pressure is just enough to displace the to-be-dredged, sediment layer without penetrating the underlying sand substrate, (ii) moving the dredging attachment 14 forward so that it becomes fully loaded with sediment, with this condition being discernable by monitoring the readings of the load cell 24, (iii) once the dredging attachment 14 is fully loaded with sediment, initiating the pumping action of the pump 16 while continuing to move forward at a rate of speed such that the dredging attachment 14 stays fully loaded, and (iv) if the situation arises that the solids content within the slurry begins to exceed the pump's rated capacity, using the system's jet water manifold system 26 to add water to the attachment's contents to reduce the slurry's solids content back to within an acceptable range.

For those skilled in the art, it will be readily apparent that the dimensions of the dredging attachment can be chosen so as to allow this dredging process to be undertaking in very shallow waters. Meanwhile, the other key components (e.g., load cell, high-solids content, variable-speed pump, water manifold system) of this invention's improvements can easily be scaled to match the overall size of the dredging attachment. Since this type of hardware is well known in the art, its description will omitted so as not to obscure the description of the present invention with unnecessary detail.

The present invention is seen to overcome the limitations of the prior art by: (1) as a result keeping the dredging attachment fully loaded so as to maximize the percentage solids content of the pumped slurry, minimizing the quantities of intake water that must be treated as a result of a dredging operation, (2) as a result of avoiding the use of bucket loading equipment, minimizing the generation of suspended sediment in the waters surrounding a dredging site, and (3) as a result of controlling the sliding pressure of the dredging attachment, providing a means for more precisely removing a specified-thickness, sediment layer from an underlying surface.

The foregoing descriptions of the invention have been presented for purposes of illustration and description. Further, the description is not intended to limit the invention to the form disclosed herein. Consequently, variations and modifications commensurate with the above teachings, and combined with the skill or knowledge in the relevant art are within the scope of the present invention.

The preferred embodiments described herein are further intended to explain the best mode known of practicing the invention and to enable others skilled in the art to utilize the invention in various embodiments and with various modifications required by their particular applications or uses of the invention. It is intended that the appended claims be construed to include alternate embodiments to the extent permitted by the current art.

We claim:

1. An improved hydraulic dredging apparatus for removing a sediment layer from an underlying substrate lying below a water surface, said dredging apparatus of the type having a surface vehicle, a boom having an end that is mounted on said surface vehicle and a submersible end that extends from said surface vehicle, and a receptacle that is attached to said boom submersible end, wherein said receptacle includes an open-front portion through which said sediment is collected and a hydraulic pump attached to said receptacle for pumping a sediment and water slurry having a percentage solids content to the water's surface, wherein said receptacle having a weight that causes a pressure on said underlying substrate and wherein said receptacle having the property that said receptacle can be filled to various degrees of said sediment, wherein the improvements comprise:

a buoyancy compensation chamber attached to said receptacle for allowing said pressure of said receptacle on the underlying substrate to be controlled, a load cell mounted on said receptacle that determines said degree to which said receptacle is full of sediment, and a water manifold system attached to said receptacle for allowing water to be added to said receptacle's contents so as to control said percentage solids content of said slurry being pumped.

2. An improved hydraulic dredging apparatus as recited in claim 1, further comprising a bottom slide runner that protrudes from a lower, leading edge of said receptacle for the purpose of preventing the receptacle from digging too deeply into the underlying substrate.

3. An improved hydraulic dredging apparatus as recited in claim 2, further comprising an adjustable, intake visor that is affixed to a top, leading edge of said receptacle for the purpose of controlling the area of the receptacle's front opening.

4. An improved hydraulic dredging apparatus as recited in claim 3, wherein said dredging apparatus means for attaching to said boom includes a means for allowing said receptacle to move up and down as said receptacle rides over uneven bottom surfaces.

5. An improved hydraulic dredging apparatus as recited in claim 2, wherein said dredging apparatus means for attaching to said boom includes a means for allowing said receptacle to move up and down as said receptacle rides over uneven bottom surfaces.

6. An improved hydraulic dredging apparatus as recited in claim 1, further comprising an adjustable, intake visor that is affixed to a top, leading edge of said receptacle for the purpose of controlling the area of the receptacle's front opening.

7. An improved hydraulic dredging apparatus as recited in claim 6, wherein said dredging apparatus means for attaching to said boom includes a means for allowing said receptacle to move up and down as said receptacle rides over uneven bottom surfaces.

8. An improved hydraulic dredging apparatus as recited in claim 1, wherein said dredging apparatus means for attaching to said boom includes a means for allowing said receptacle to move up and down as said receptacle rides over uneven bottom surfaces.

9. An improved hydraulic dredging apparatus for removing a sediment layer from an underlying substrate lying below a water surface, said dredging apparatus of the type having a surface vehicle, a boom having an end that is mounted on said surface vehicle and a submersible end that extends from said surface vehicle, and a receptacle that is attached to said boom submersible end, wherein said receptacle includes an open-front portion through which said sediment is collected and a hydraulic pump attached to said receptacle for pumping a sediment and water slurry having a percentage solids content to the water's surface, wherein said receptacle having a weight that causes a pressure on said underlying substrate and wherein said receptacle having the property that said receptacle can be filled to various degrees of said sediment, wherein the improvement comprises:

a means for providing buoyancy to said receptacle for allowing the pressure of said receptacle on the underlying substrate to be controlled, and a means mounted on said receptacle for measuring said degree to which said receptacle is filled.

10. An improved hydraulic dredging apparatus as recited in claim 9, further comprising a means for supplying water to said receptacle for allowing water to be added to said receptacle's contents so as to control said percentage solids content of said slurry being pumped.

11. An improved hydraulic dredging apparatus as recited in claim 10, further comprising a means, connected to a lower, leading edge of said receptacle, for preventing the receptacle from digging too deeply into the underlying substrate.

12. An improved hydraulic dredging apparatus as recited in claim 11, further comprising a means, affixed to a top, leading edge of said receptacle, for adjustably controlling the area of the receptacle's front opening.

13. An improved hydraulic dredging apparatus as recited in claim 12, wherein said dredging apparatus means for connecting to said boom includes a means for allowing said receptacle to move up and down as said receptacle rides over uneven bottom surfaces.

14. An improved method for using a hydraulic dredging apparatus to remove a sediment layer from an underlying substrate lying below a water surface, said dredging apparatus of the type having a surface vehicle, a boom having an end that is mounted on said surface vehicle and a submersible end that extends from said surface vehicle, a receptacle that is attached to said boom submersible end and a means for providing buoyancy to said receptacle, wherein said receptacle includes an open-front portion through which said sediment is collected and a hydraulic pump attached to said receptacle for pumping a sediment and water slurry to the water's surface, wherein said receptacle having a weight that causes a pressure on said underlying substrate and wherein said receptacle having the property that said receptacle can be filled at any one of a plurality of fill rates with various degrees of said sediment, wherein said method comprising the steps of:

sliding said open-front receptacle along the interface between said sediment layer and substrate so as to collect said sediment in said receptacle, utilizing said means for providing buoyancy for controlling said pressure that said sliding receptacle exerts on said underlying substrate so as to allow said receptacle's bottom surface to follow the interface between said sediment layer and substrate, once the receptacle is loaded to a desired level of sediment, pumping a slurry of said collected sediment and surrounding water from said receptacle to the water's surface while continuing to slide said receptacle forward so that said rate at which sediment enters said receptacle is approximately equal to the rate at which sediment is being pumped to the water's surface, and controlling a percentage solids content within said receptacle so as to not exceed the maximum-specified, solids concentration rating of said pump while minimizing the amount of water pumped with said sediment.

15. An improved method for using a hydraulic dredging apparatus to remove a sediment layer from an underlying substrate lying below a water surface as recited in claim 14, wherein said step of controlling the percentage solids content within said receptacle is accomplished in part by using a load cell mounted on said receptacle to determine the degree to which said receptacle is full of collected sediment and using a water manifold system that is mounted to said receptacle to add water on a specified, as-needed basis to said receptacle's contents.

16. An improved method for using a hydraulic dredging apparatus to remove a sediment layer from an underlying substrate lying below a water surface as recited in claim 14, wherein said step of controlling the percentage solids content within said receptacle is accomplished in part by using a load cell mounted on said receptacle to determine the degree to which said receptacle is full of collected sediment and using a water manifold system that is mounted to said receptacle to add water on a specified, as-needed basis to said receptacle's contents.

* * * * *